US010184745B1

(12) United States Patent
Fulton

(10) Patent No.: US 10,184,745 B1
(45) Date of Patent: Jan. 22, 2019

(54) PISTOL SUPPRESSOR

(71) Applicant: PRECISION TOOLING PRODUCTS, LLC, Mayfield, KY (US)

(72) Inventor: Joshua S. Fulton, Mayfield, KY (US)

(73) Assignee: PRECISION TOOLING PRODUCTS, LLC, Mayfield, KY (US)

( * ) Notice: Subject to any disclaimer, the term of this patent is extended or adjusted under 35 U.S.C. 154(b) by 0 days.

(21) Appl. No.: 15/942,128

(22) Filed: Mar. 30, 2018

(51) Int. Cl.
*F41A 21/32* (2006.01)
*F41A 21/30* (2006.01)

(52) U.S. Cl.
CPC ..... *F41A 21/325* (2013.01); *F41A 21/30* (2013.01)

(58) Field of Classification Search
CPC ..... F41A 21/30; F41A 21/32; F41A 21/325; F41A 21/34; F41A 21/36; F41A 21/38
USPC ..... 89/14.3, 14.4; 42/1.06
See application file for complete search history.

(56) References Cited

U.S. PATENT DOCUMENTS 3,677,132 A * 7/1972 Plenge ..... F41A 21/30 42/1.14
4,510,843 A 4/1985 Rabatin
7,891,282 B1 2/2011 DeGroat
7,905,171 B1 3/2011 Brittingham
8,272,306 B1 9/2012 Smith
2009/0050403 A1* 2/2009 Brittingham ..... F41A 21/30 181/223
2012/0279381 A1* 11/2012 Landolt ..... F41A 21/30 89/14.4
2014/0353076 A1* 12/2014 Bethlenfalvy ..... F41A 21/30 181/223
2016/0010936 A1* 1/2016 Moon ..... F41A 21/36 89/14.3
2016/0209151 A1* 7/2016 Smith ..... F41A 21/30
2017/0167816 A1* 6/2017 Young ..... F41A 21/325
2017/0205176 A1* 7/2017 Whitson ..... F41A 21/325
2017/0241733 A1* 8/2017 Salvador ..... F41A 21/325
2018/0106569 A1* 4/2018 Smith ..... F41A 21/30

* cited by examiner

*Primary Examiner* — Bret Hayes
(74) *Attorney, Agent, or Firm* — Shane Cortesi

(57) ABSTRACT

A firearm booster assembly is described that includes a mounting piston, a main housing comprising a housing interior and optionally a locking cap removably attached to the mounting piston. The mounting piston and locking cap may be at least partially located in the housing interior. The housing exterior may include threads removably attaching the booster assembly to a suppressor or other barrel accessory and the mounting piston may include threads attaching the booster assembly to a barrel of a pistol or other firearm. The housing interior preferably includes at least one O-ring or other seal and the housing exterior preferably includes no holes leading to the housing interior. Upon attachment of the booster assembly to a suppressor and pistol and firing the pistol, the main housing preferably moves forwardly relative to the mounting piston.

22 Claims, 6 Drawing Sheets

PISTOL SUPPRESSOR

BACKGROUND

Technical Field

The present invention relates to firearm barrel accessories such as suppressors, also known as silencers.

Background of the Invention

Firearm suppressors, commonly referred to as gun silencers are known in the art. In some prior art devices firearm suppressors may be threaded to the muzzle of the gun barrel.

Prior art systems for coupling suppressors to pistols are known. For example, U.S. Pat. No. 8,272,306 describes a coupler that is configured to attach to a housing and includes a piston that moves relative to a housing. The housing is coupled to a suppressor and includes a plurality of holes to allow gas to escape. In practice, the aforementioned system is prone to getting dirty (and hence locking up), which makes it unusable in military situations.

Thus, there is a need for new couplers that couple a suppressor to a firearm such as a pistol without being prone to getting dirty and locking up.

BRIEF SUMMARY

The present disclosure provides a firearm barrel accessory system as described herein.

In some embodiments, the present disclosure provides a firearm booster system comprising one or more of the following features: a) a firearm comprising a trigger configured to toggle between a trigger rest position and a trigger pull position and a gun barrel comprising a muzzle configured to fire ammunition when the trigger is in the trigger pull position; b) a mounting piston comprising a rear end attached to the muzzle, a forward end, a mounting piston length extending from the forward end to the rear end, a mounting piston interior, and a mounting piston exterior comprising a mounting piston circumference generally perpendicular to the mounting piston length, a plurality of mounting piston teeth spaced about the mounting piston circumference, wherein the plurality of mounting piston teeth have a length generally parallel to the mounting piston length; c) a main housing comprising a housing forward end, a housing rear end, a housing length extending from the housing forward end to the housing rear end, a housing exterior, a housing interior comprising a housing interior circumference extending generally perpendicular to the housing length and a plurality of housing teeth receivers spaced about the housing interior circumference, the plurality of housing teeth receivers configured to mate with the mounting piston teeth and having a length generally parallel to the mounting piston length, the main housing interior comprising a portion of the mounting piston; and d) a compressible spring extending along at least a portion of the housing length and located in the housing interior of the main housing, the compressible spring comprising a rear end and a forward end, the compressible spring having a relaxed length and a compressed length. Optionally, the mounting piston is partly disposed in the housing interior of the main housing. Optionally, after moving the trigger between the trigger pull position and the trigger rest position (e.g., firing the pistol), the housing teeth receivers are configured to first move from a start position forwardly relative to and along at least a portion of the length of the mounting piston teeth and the rear end of the compressible spring is configured to move toward the forward end of the compressible spring as the compressible spring moves from the relaxed state to the compressed state and then the housing teeth receivers are configured to move rearwardly relative to and along at least a portion of the length of the mounting piston teeth to return to the start position and the rear end of the compressible spring is configured to move rearwardly as the compressible spring returns to the relaxed state. Optionally, moving the trigger from the trigger rest position to the trigger pull position is configured to fire the ammunition from the muzzle through the mounting piston interior.

Optionally, the housing exterior comprises housing exterior threads. Optionally, the housing exterior has no holes leading to the housing interior along the main housing length. Optionally, the system further comprises a rear seal disposed forwardly relative to the mounting piston teeth and a forward seal disposed forward to the rear seal, the forward seal and the rear seal disposed in the housing interior of the main housing. Optionally, the housing interior of the main housing comprises a rear groove extending about the housing interior circumference of the main housing and a forward groove disposed forward to the rear groove and extending about the housing interior circumference of the main housing, and further wherein the rear seal is a rear O-ring disposed in the rear groove and the forward seal is a forward O-ring disposed in the forward groove, and further wherein the rear O-ring extends about the mounting piston circumference. Optionally, the housing interior of the main housing comprises a forward ledge confronting the spring forward end at least when the main housing teeth receivers move forwardly relative to and along the mounting piston teeth length and a first rear ledge confronting the spring rear end at least when the main housing teeth receivers move forwardly relative to and along the mounting piston teeth length. Optionally, the spring forward end is rearwardly located relative to the forward groove and the spring rear end is forwardly located relative to the rear groove. Optionally, the mounting piston exterior further comprises a mounting piston flange forming a mounting piston ledge spaced about the mounting piston circumference, the mounting piston ledge adjacent to the mounting piston teeth, wherein the housing interior of the main housing comprises a second rear ledge rearwardly disposed to the first rear ledge, wherein the mounting piston ledge contacts the second rear ledge when the main housing is in the start position and the mounting piston ledge does not contact the second rear ledge when the main housing teeth receivers move forwardly relative to and along the mounting piston length, and further wherein the rear groove is located between the first rear ledge and second rear ledge. Optionally, the system further comprises a locking cap comprising a locking cap forward end disposed forward relative to the mounting piston forward end, a locking cap rear end, a locking cap length extending from the locking cap forward end to the locking cap rear end, a locking cap interior, the locking cap at least partially disposed in the housing interior, the locking cap and the mounting piston comprise mating threads removably attaching the locking cap to the mounting piston, the locking cap configured to rotate relative to the mounting piston as the threads of the locking cap move along the mating threads of the mounting piston. Optionally, upon moving the trigger from the trigger rest position to the trigger pull position, the firearm booster system is configured to deliver the ammunition and gas through the mounting piston interior, through the locking cap interior and out of the locking cap forward end without the gas contacting the compressible spring.

Optionally, the locking cap comprises a forward ledge and a groove disposed forwardly relative to the forward ledge and further wherein the forward end of the spring rests upon the forward ledge at least when the main housing teeth receivers move forwardly relative to and along the mounting piston teeth length. Optionally, the locking cap groove comprises a forward O-ring. Optionally, the housing teeth receivers are configured to move from the start position and return to the start position without the main housing rotating relative to the mounting piston. Optionally, the muzzle and the mounting piston interior comprises mating threads removably attaching the mounting piston to the muzzle. Optionally, the firearm is a pistol comprising a slide and the muzzle is configured to move vertically upwardly when firing ammunition. Optionally, the spring is a wave spring. Optionally, the housing interior of the main housing comprises a forward ledge confronting the spring forward end at least when the main housing teeth receivers move forwardly relative to and along the mounting piston teeth length and a rear ledge confronting the spring rear end at least when the main housing teeth receivers move forwardly relative to and along the mounting piston teeth length. Optionally, the system further comprises a suppressor barrel attached to the housing exterior, the housing exterior further comprising threads, the suppressor barrel comprising an interior comprising at least one baffle, the suppressor barrel configured to reduce noise when the ammunition is fired from the pistol, the suppressor barrel interior further comprising suppressor barrel interior threads mating with the housing exterior threads. Optionally, the suppressor barrel comprises a forward end, the firearm booster system configured to fire ammunition from the muzzle through the mounting piston interior, through the housing interior, through the suppressor barrel interior and out the suppressor barrel forward end when the trigger is moved from the trigger rest position to the trigger pull position. Optionally, the suppressor is configured to move with the main housing as the main housing teeth move relative to the mounting piston teeth. Optionally, the rear end of the main housing comprises bevels. Optionally, each of the housing teeth receivers and the mounting piston teeth have a length of between about ⅛ of an inch to about 3⁄16 of an inch.

The present disclosure further provides a method of using a firearm booster system comprising the steps of: a) providing the firearm booster system; b) moving the trigger from the trigger rest position to the trigger pull position; c) moving the main housing and the suppressor barrel forwardly relative to the muzzle and the mounting piston and ejecting ammunition from the muzzle through the mounting piston interior, through the suppressor barrel and out of the suppressor barrel forward end. The system used in such a method may have any of the features described above and preferably the suppressor reduces the noise emanating from the firearm.

DETAILED DESCRIPTION

Figure 1:
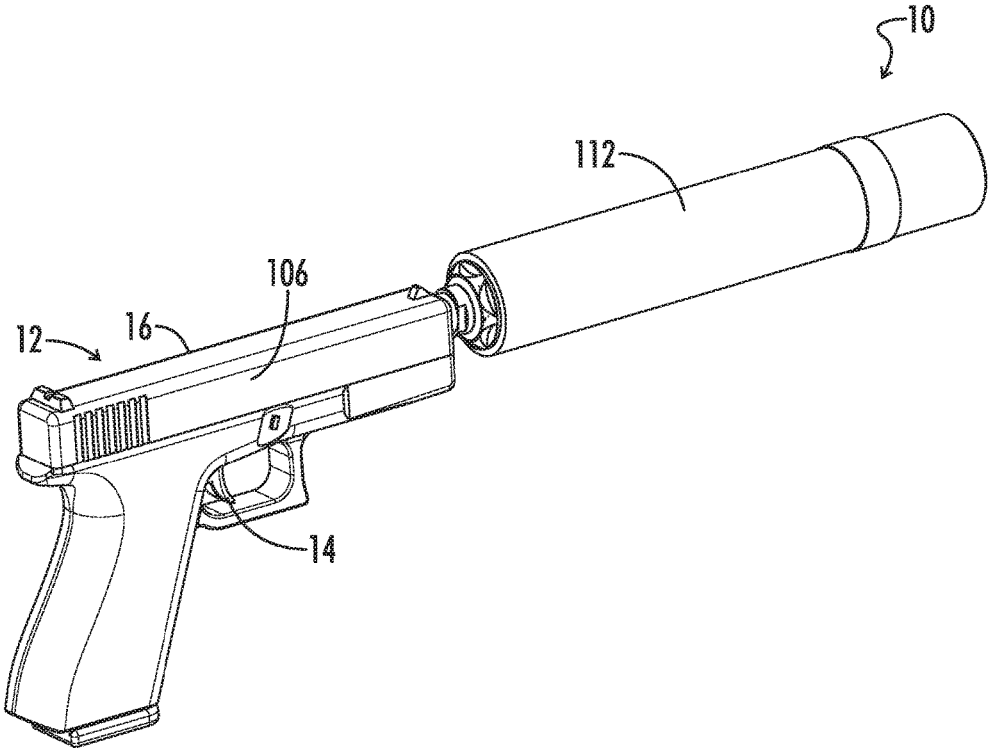
FIG. 1 illustrates a side perspective view of a booster assembly of one embodiment of the present invention connecting a pistol to a suppressor.
Figure 2:
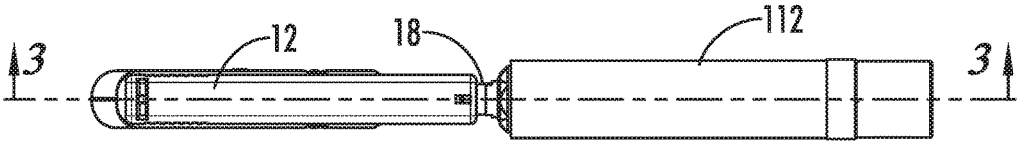
FIG. 2 illustrates a top plan view of the booster assembly, pistol and suppressor of FIG. 1.
Figure 3:
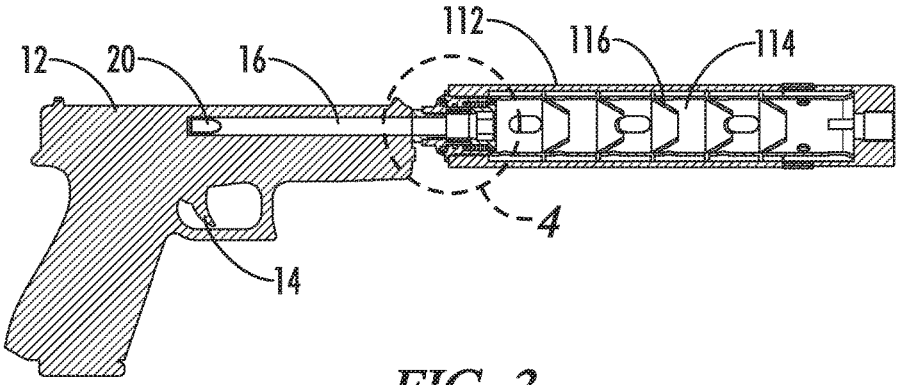
FIG. 3 illustrates a side sectional view of the booster assembly, pistol and suppressor of FIG. 1.

With reference to FIGS. 1-9B, the present disclosure provides a firearm booster system designated by the numeral 10. In the drawings, not all reference numbers are included in each drawing for the sake of clarity. In addition, although the firearm booster system 10 is preferably used to attach a firearm 12 to a firearm suppressor barrel 112 of a suppressor, other firearm barrel accessories may use the attachment described herein.

Referring further to FIGS. 1-9B, the firearm booster system 10 may include a firearm 12 comprising a trigger 14 configured to toggle between a trigger rest position and a trigger pull position and a gun barrel 16 comprising a muzzle 18 configured to fire ammunition 20 when the trigger 14 is in the trigger pull position. The firearm 12 may be any suitable firearm but is preferably a pistol that includes a slide 106 or another autoloading handgun as described in U.S. Pat. No. 8,272,306 (the '306 patent) that employ the action developed by John Browning. The entire contents of the '306 patent is incorporated herein by reference. As explained in the '306 patent, the rear (proximal end) of the barrel 16 goes down below the axis of the slide 106 while the forward (distal end) of the barrel 16, the muzzle 18, goes up above the axis of the slide 106. The ability of the barrel's muzzle 18 to rise above the axis of the slide 106 when such handguns are attached to a suppressor is important to the functioning of the handgun. Thus, as described in the '306 patent, boosters are designed to alleviate the weight of the silencer on the muzzle, allowing the handgun to function properly. As the present invention describes an improvement to such a booster (also referred to herein as a booster assembly), the firearm booster system 10 herein is preferably used in combination with barrels 16 whose muzzles 18 move upward above the axis of the slide 106 after the trigger 14 is pulled and whose rears tilt downward to allow the extraction and ejection of the empty cartridge case and the feeding of a live cartridge into the chamber.

As used herein, the terms "rear" and "forward" refer to the fact that the fact that the ammunition 20 (e.g., bullet) travels from the rear components to the forward components of the firearm booster system 10 after the trigger 14 moves from the trigger rest position to the trigger pull position to fire the ammunition 20.

The firearm booster system 10 may further include a mounting piston 22 (preferably in the form of a shaft) comprising a rear end 24 attached to the muzzle 18, a forward end 26, a mounting piston length 28 extending from the forward end 26 to the rear end 24, a mounting piston interior 30, and a mounting piston exterior 32 comprising a mounting piston perimeter/circumference 34 generally perpendicular to the mounting piston length 28, one or more mounting piston tooth 36 (preferably a plurality of mounting piston teeth 38 spaced about the mounting piston circumference 40). Optionally, the plurality of mounting piston teeth 36 have a length 38 generally parallel to the mounting piston length 28.

The firearm booster system 10 may also include a main housing 40 (also referred to herein as a housing) comprising a housing forward end 42, a housing rear end 44, a housing length 46 extending from the housing forward end 42 to the housing rear end 44, a housing exterior 48, a housing interior 50 comprising a housing interior perimeter/circumference 52 extending generally perpendicular to the housing length 46 and one or more housing teeth receivers 54 (preferably a plurality of housing teeth receivers 54 spaced about the housing interior circumference 52). Preferably the plurality of housing teeth receivers 54 are configured to mate with the mounting piston teeth 36 (and slide along the mounting piston teeth length 38 when the main housing 40 moves forwardly as described below) and have a length 56 generally parallel to the mounting piston length 28, the main housing interior 50 comprising a portion of the mounting piston 22. A purpose of the housing teeth receivers 54 is to prevent the main housing 40 from rotating as the main housing 40 moves relative to the mounting piston 22. Thus, preferably the housing teeth receivers 54 are configured to move from the start position and return to the start position without the main housing 40 rotating relative to the mounting piston 22. The main housing 40 preferably serves as the suppressor barrel mount, because it preferably threads to the suppressor barrel 112, as described below.

The firearm booster system 10 may further include a compressible spring 58 extending along at least a portion of the mounting piston length 28 and housing length 46 and located in the housing interior of the main housing 40. In other words, the compressible spring 58 preferably is fully located in the housing interior 50. The compressible spring 58 has a rear end 60 and a forward end 62 and a relaxed length 64, shown in FIG. 9A, and a compressed length 64, shown in FIG. 9B.

Preferably, the mounting piston 22 is partly disposed in the housing interior 50 of the main housing 40. Preferably, after moving the trigger 14 between the trigger pull position and the trigger rest position, the housing teeth receivers 54 are configured to first move/slide from a start position forwardly relative to and along at least a portion of the length 38 of the mounting piston teeth 36 and the rear end 60 of the compressible spring 58 is configured to move toward the forward end 62 of the compressible spring 58 as the compressible spring 58 is configured to move from the relaxed state to the compressed state, as shown by comparing FIG. 9B with FIG. 9A, and then the housing teeth receivers 54 are configured to move rearwardly relative to and along at least a portion of the length 38 of the mounting piston teeth 36 to return to the start position and the rear end 60 of the compressible spring 58 is configured to move rearwardly as the compressible spring 58 returns to the relaxed state. Preferably, moving the trigger 14 from the trigger rest position to the trigger pull position is configured to fire the ammunition 20 from the muzzle 18 through the mounting piston interior 30. It will be understood that the movement of the main housing 40 relative to the mounting piston 22 is relative. In practice, the main housing 40 (and attached suppressor barrel 114) may move forwardly and the mounting piston 22 (and attached firearm muzzle 18) may move rearwardly.

The housing exterior 48 may comprise housing exterior threads 66, as best seen in FIGS. 4-9B, to enable attachment to the interior threads 118 of a suppressor barrel 112.

Figure 4:
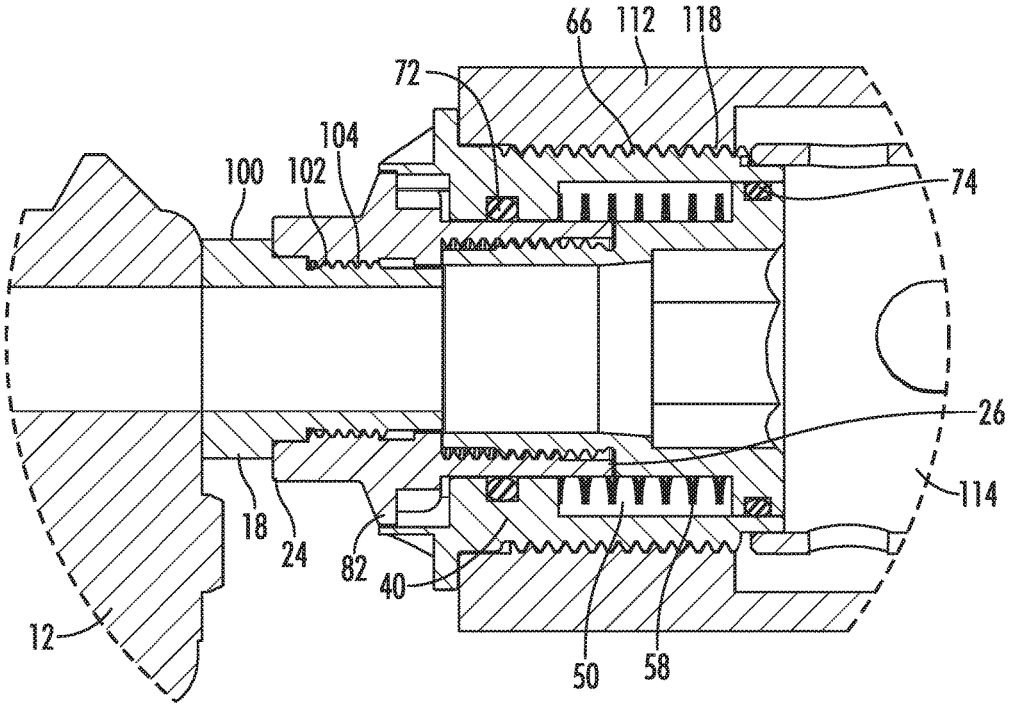
FIG. 4 illustrates a side sectional view of the area circled 4 in FIG. 3.

Optionally, upon moving the trigger 14 from the trigger rest position to the trigger pull position, the firearm booster system 10 is configured to deliver the ammunition 20 and gas through the mounting piston interior 30 so that the ammunition 20 and gas exit out of the locking cap forward end 88 without contacting the compressible spring 58. Optionally, as best seen in FIGS. 3-9B, the housing exterior 48 has no holes leading to the housing interior 50 along the main housing length 46. As explained above, the holes described in the '306 patent cause the firearm booster system to be prone to getting dirty and locking up. Thus, preferably, the firearm booster system 10 of the present disclosure is a sealed system that is not prone to locking up. In addition, as compared to prior art systems, the mounting piston teeth 36 are located in the rear portion of the booster assembly 10 and rearwardly relative to rear O-ring 72 so that they do not collect debris. (By contrast in the '306 patent, the protrusions/teeth labelled as 32 are located in the forward portion of the booster labelled as 10). Optionally, as shown in FIGS. 4-9B, the firearm booster system 10 further includes a rear seal in the form of a rear O-ring 72 disposed forwardly relative to the mounting piston teeth 36 and a forward seal in the form of a forward O-ring 74 disposed forward to the rear O-ring 72, the forward O-ring 74 and the rear O-ring 72 disposed in the housing interior 50 of the main housing 40. Preferably, the forward O-ring 74 is located forward relative to the spring forward end 62 and the rear O-ring 72 is located rearwardly to the spring rear end 60. More particularly, as shown in FIGS. 4-9B, the housing interior 50 of the main housing 40 may comprise a rear groove 68 extending about the housing interior circumference 52 of the main housing 40 and a forward groove 70 disposed forward to the rear groove 68 and extending about the housing interior circumference 52 of the main housing 40, and the rear O-ring 72 is disposed in the rear groove 68 and the forward O-ring 74 is disposed in the forward groove 70, and the rear O-ring 72 extends about the mounting piston circumference 34. It will be appreciated that, more particularly, the forward groove 70 is preferably formed between the locking cap 76 (described below) and the main housing 40 and the rear groove 68 is preferably formed between the main housing 40 and the mounting piston 22, as shown in FIGS. 4-9B. Optionally, the housing interior 50 of the main housing 40 comprises a forward ledge 78 confronting the spring forward end 62 at least when the main housing teeth receivers 54 move forwardly relative to and along the mounting piston teeth length 38 (i.e., at least when the spring 58 is in the compressed state), and a first rear ledge confronting the spring rear end 60 at least when the main housing teeth receivers 54 move forwardly relative to and along the mounting piston teeth length 38 (i.e., at least when the spring 58 is in the compressed state), as shown in FIGS. 4 and 9A and 9B. Optionally, the spring forward end 62 is rearwardly located relative to the forward groove 70 and the spring rear end 60 is forwardly located relative to the rear groove 68. Optionally, the mounting piston exterior 32 further comprises a mounting piston flange 82 forming a mounting piston ledge 84 spaced about the mounting piston circumference 34, the mounting piston ledge 84 adjacent to the mounting piston teeth 36, and the housing interior 50 of the main housing 40 comprises a second rear ledge 86 rearwardly disposed to the first rear ledge 80, and the mounting piston ledge 84 contacts the second rear ledge 86 when the main housing 40 is in the start position and the mounting piston ledge 84 does not contact the second rear ledge 86 when the main housing teeth receivers 54 move forwardly relative to and along the mounting piston teeth length 38, and the rear groove 68 is located between the first rear ledge 80 and second rear ledge 86.

Figure 5:
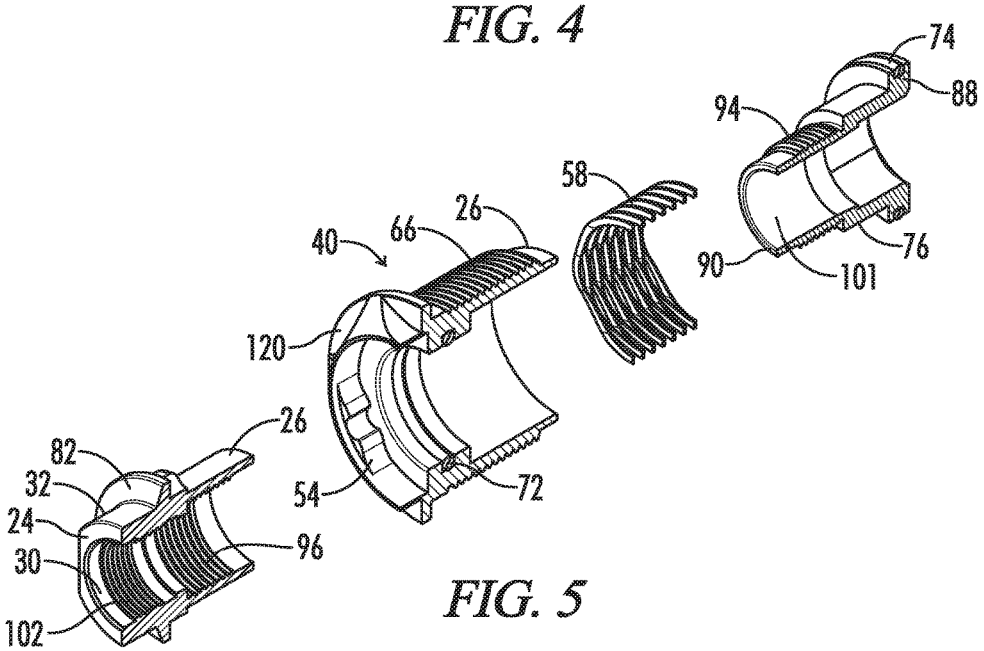
FIG. 5 illustrates a side, exploded partial sectional view of the booster assembly of FIG. 1.
Figure 6:
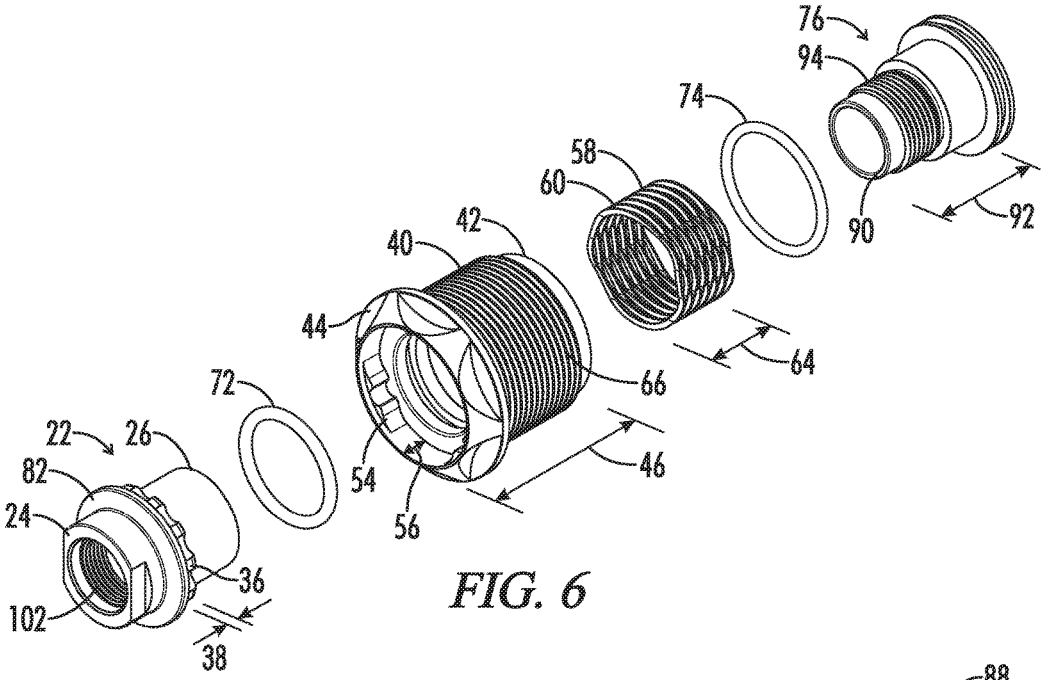
FIG. 6 illustrates a side, exploded perspective view of the booster assembly of FIG. 1.
Figure 7:
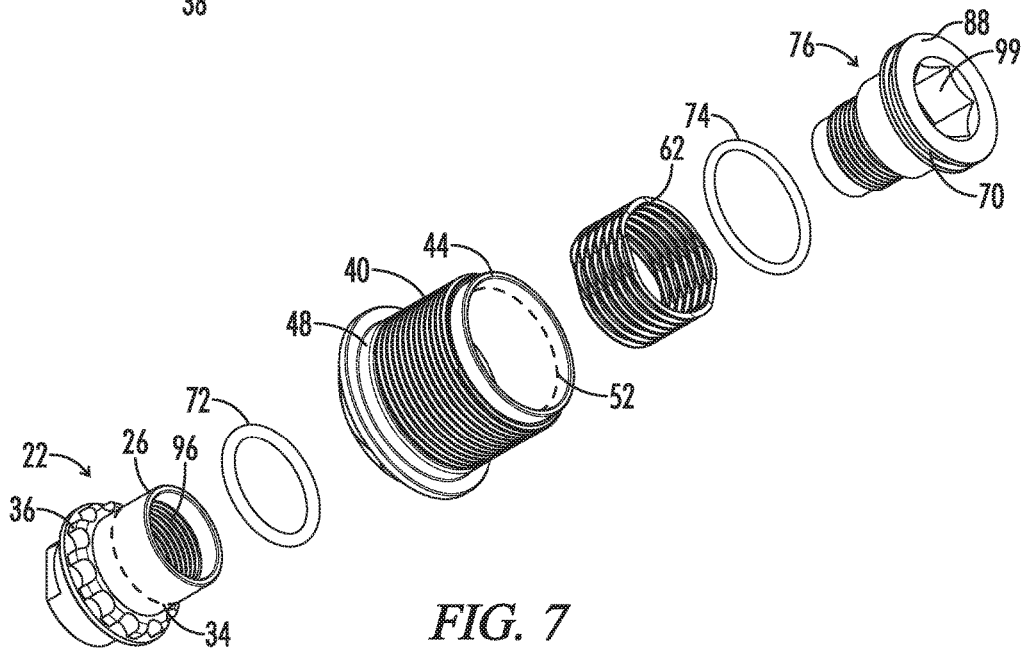
FIG. 7 illustrates a side, exploded perspective view of the booster assembly of FIG. 1.

Optionally, the firearm booster system further includes a locking cap 76 comprising a locking cap forward end 88 disposed forward relative to the mounting piston forward end 26, a locking cap rear end 90, a locking cap length 92 extending from the locking cap forward end 88 to the locking cap rear end 90, and a locking cap interior 101. The locking cap 76 may be at least partially disposed in the housing interior 50. The locking cap 76 may be removably attached to the mounting piston 22. More particularly, the locking cap 76 and the mounting piston 22 may each comprise threads 94 and 96 configured to removably attach the locking cap 76 to the mounting piston 22, as seen in FIGS. 4-9B. As shown in FIGS. 5-7, the mounting piston 22 may comprise two groups of threads separated by a partial interior wall: a forward group labelled as 96 designed to attach to the locking cap threads; and a rear group labelled as 102 designed to attach to the muzzle 18. To attach the locking cap 76 to the mounting piston 22, the locking cap 76 may be configured to rotate relative to the mounting piston 22 as the threads 94 of the locking cap 76 move along the mating threads 94 of the mounting piston 22. Optionally, the locking cap 76 creates the aforementioned forward ledge 78 and the locking cap 76 creates the aforementioned forward groove 70. Once the locking cap 76 is attached to the mounting piston 22, the locking cap 76 moves with the mounting piston 22 relative to the main housing 40—i.e., upon moving the trigger 14 from the trigger rest position to the trigger pull position, both the locking cap 76 and mounting piston 22 preferably move rearwardly and the main housing 40 preferably moves forwardly as described above.

Optionally, the muzzle 18 comprises an exterior 100 comprising muzzle threads 104, the mounting piston interior 30 comprises mounting piston rear interior threads 102 and further wherein the muzzle threads 104 are mated with the mounting piston rear interior threads 102.

Optionally, the compressible spring 58 is generally cylindrical. For example, the spring 58 may be a wave spring.

Optionally, the firearm booster system further comprises a suppressor barrel 112 of a suppressor attached to the housing exterior 48, as seen in FIGS. 1-4 and 9A and 9B. The suppressor barrel 112 preferably comprises an interior 114 comprising at least one baffle 116. The suppressor barrel 112 is preferably configured to reduce noise when the ammunition 20 is fired/delivered from the pistol 12. The suppressor barrel interior 114 preferably further comprises suppressor barrel interior threads 118 configured to mate with the housing exterior threads 66, as best seen in FIGS. 4, 9A and 9B. Suppressors are well-known in the art and the firearm booster system 10 is designed to work with a variety of suppressors.

Optionally, the suppressor barrel 112 comprises a forward end, and the firearm booster system 10 is configured to fire ammunition 20 from the muzzle 18 through the mounting piston interior 30, through the locking cap interior 101, through the suppressor barrel interior 114 and out the suppressor barrel forward end when the trigger 14 is moved from the trigger rest position to the trigger pull position.

Figure 8:
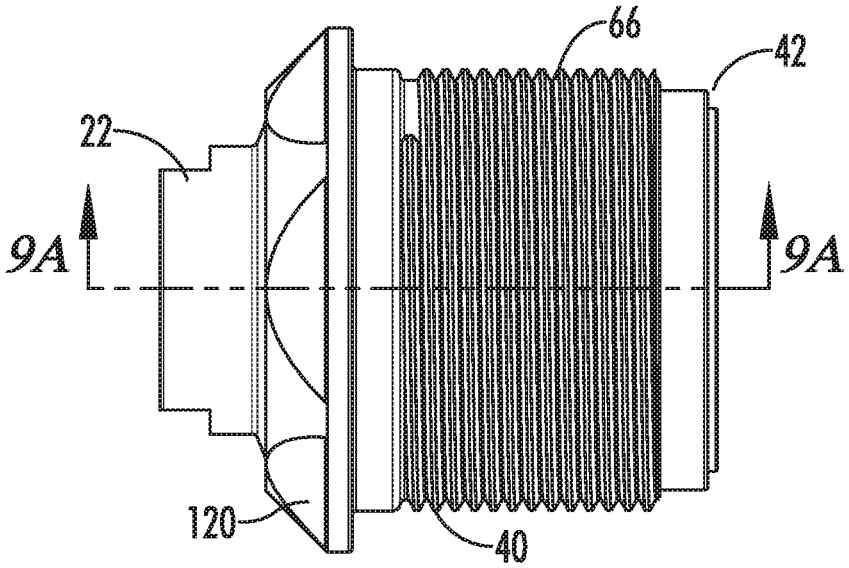
FIG. 8 illustrates a side elevation view of the booster assembly of FIG. 1.
Figure 9A:
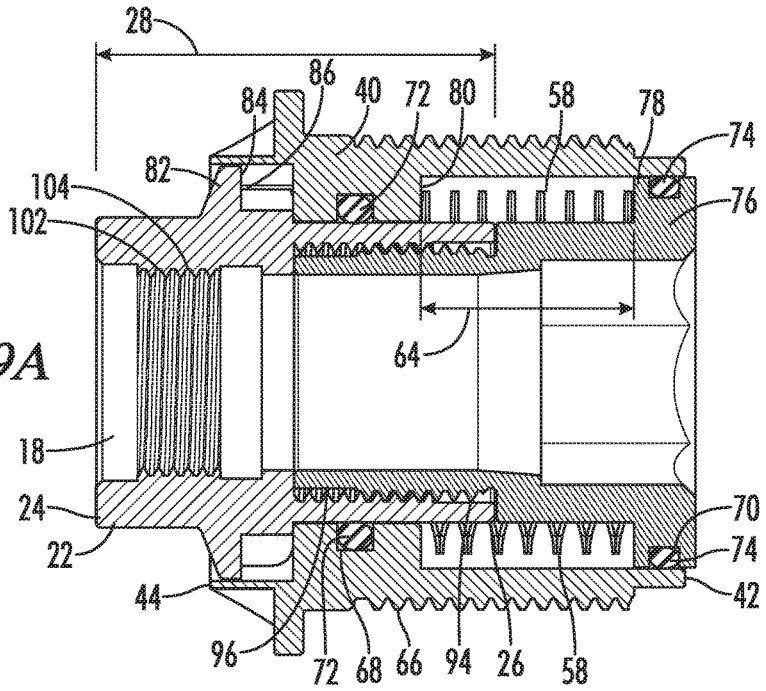
FIG. 9A illustrates a sectional view of the booster assembly of FIG. 8, taken along line 9A-9A of FIG. 8, attached to a pistol and a suppressor before moving the trigger from the trigger rest position to the trigger pull position.
Figure 9B:
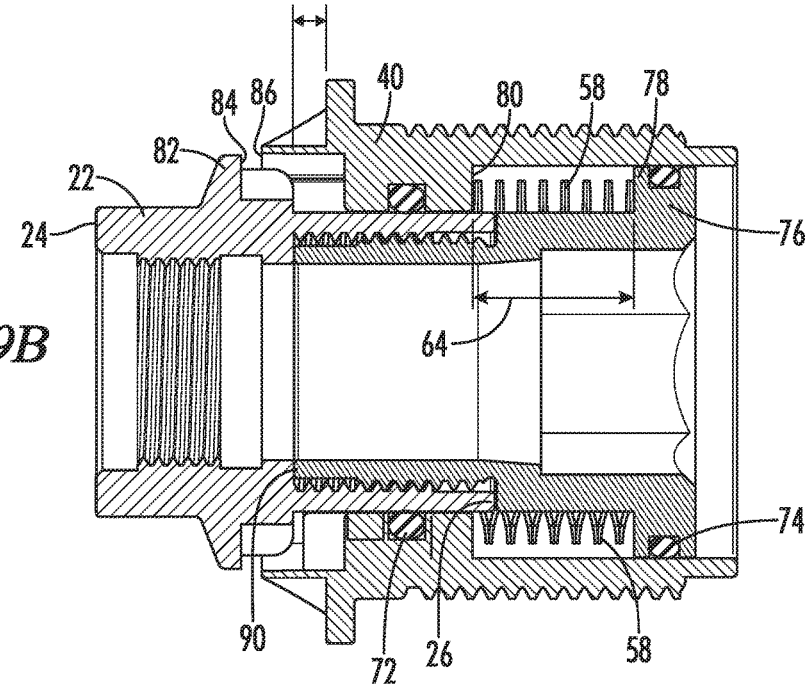
FIG. 9B illustrates a sectional view of the booster assembly of FIG. 1 attached to a pistol and a suppressor after moving the trigger from the trigger rest position to the trigger pull position.

Optionally, the rear end 44 of the main housing 40 comprises bevels 120, as seen in FIGS. 5, 6 and 8 for example.

Optionally, each of the housing teeth receivers 54 and the mounting piston teeth 36 have a length 56 and 38 of between about ⅛ of an inch to about 3/16 of an inch. However, as noted previously, the dimensions provided herein are exemplary and may be modified. It will also be appreciated that the pitch of the threads 66 and 102 may be altered depending on the type of pistol 12 or suppressor being used.

The drawings provided herein are engineering drawings to scale. However, it will be appreciated that other dimensions and component ratios are possible.

| Part List | |
|---|---|
| firearm booster system | 10 |
| firearm | 12 |
| firearm trigger | 14 |
| firearm gun barrel | 16 |
| firearm muzzle | 18 |
| ammunition | 20 |
| mounting piston | 22 |
| mounting piston rear end | 24 |
| mounting piston forward end | 26 |
| mounting piston length | 28 |
| mounting piston interior | 30 |
| mounting piston exterior | 32 |
| mounting piston perimeter/circumference | 34 |
| mounting piston teeth | 36 |
| mounting piston teeth length | 38 |
| main housing | 40 |
| housing forward end | 42 |
| housing rear end | 44 |
| housing length | 46 |
| housing exterior | 48 |
| housing interior | 50 |
| housing interior perimeter/circumference | 52 |
| housing teeth receivers | 54 |
| housing teeth receivers length | 56 |
| compressible spring | 58 |
| compressible spring rear end | 60 |
| compressible spring forward end | 62 |
| compressible spring length | 64 |
| housing exterior threads | 66 |
| rear groove | 68 |
| forward groove | 70 |
| rear O-ring | 72 |
| forward O-ring | 74 |
| locking cap | 76 |
| forward ledge | 78 |
| first rear ledge | 80 |
| mounting piston flange | 82 |
| mounting piston ledge | 84 |
| second rear ledge | 86 |
| locking cap forward end | 88 |
| locking cap rear end | 90 |
| locking cap length | 92 |
| locking cap mating threads | 94 |
| mounting piston mating threads | 96 |
| locking cap hex head | 99 |
| muzzle exterior | 100 |
| Locking cap interior | 101 |
| mounting piston interior threads for attachment to muzzle | 102 |
| muzzle threads | 104 |
| pistol slide | 106 |
| suppressor barrel | 112 |
| suppressor barrel interior | 114 |
| suppressor barrel interior baffle | 116 |
| suppressor barrel interior threads | 118 |
| main housing rear end bevels | 120 |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A firearm booster system comprising:

a) a firearm comprising a trigger and a gun barrel comprising a muzzle configured to fire ammunition;

b) a mounting piston comprising a rear end attached to the muzzle, a forward end, a mounting piston length extending from the forward end to the rear end, a mounting piston interior, and a mounting piston exterior comprising a mounting piston circumference generally perpendicular to the mounting piston length, a plurality of mounting piston teeth spaced about the mounting piston circumference, wherein the plurality of mounting piston teeth have a length generally parallel to the mounting piston length;

c) a main housing comprising a housing forward end, a housing rear end, a housing length extending from the housing forward end to the housing rear end, a housing exterior, a housing interior comprising a housing interior circumference extending generally perpendicular to the housing length and a plurality of housing teeth receivers spaced about the housing interior circumference, the plurality of housing teeth receivers configured to mate with the mounting piston teeth and having a length generally parallel to the mounting piston length, the main housing interior comprising a portion of the mounting piston; and d) a compressible spring extending along at least a portion of the housing length and located in the housing interior of the main housing, the compressible spring comprising a rear end and a forward end, the compressible spring having a relaxed length and a compressed length;

wherein the mounting piston is partly disposed in the housing interior of the main housing, and wherein upon firing the firearm, the firearm booster system is configured to deliver the ammunition and gas through the mounting piston interior and through the housing interior and the housing teeth receivers are configured to first move from a start position forwardly relative to and along at least a portion of the length of the mounting piston teeth and the rear end of the compressible spring is configured to move toward the forward end of the compressible spring as the compressible spring moves from the relaxed state to the compressed state and then the housing teeth receivers are configured to move rearwardly relative to and along at least a portion of the length of the mounting piston teeth to return to the start position and the rear end of the compressible spring is configured to move rearwardly as the compressible spring returns to the relaxed state, wherein the firearm booster system further comprises a rear seal disposed forwardly relative to the mounting piston teeth and rearwardly relative to the spring rear end and a forwardly relative seal disposed forward to the rear seal and forwardly relative to the spring forward end, the forward seal and rear seal disposed in the housing interior of the main housing, and configured to prevent the gas from contacting the compressible spring.

2. The firearm booster system of claim 1 wherein the housing exterior comprises housing exterior threads.

3. The firearm booster system of claim 1 wherein the housing exterior has no holes leading to the housing interior along the main housing length.

4. The firearm booster system of claim 1 wherein the housing interior of the main housing comprises a rear groove extending about the housing interior circumference of the main housing and a forward groove disposed forward to the rear groove and extending about the housing interior circumference of the main housing, and further wherein the rear seal is a rear O-ring disposed in the rear groove and the forward seal is a forward O-ring disposed in the forward groove, and further wherein the rear O-ring extends about the mounting piston circumference.

5. The firearm booster system of claim 4 wherein the housing interior of the main housing comprises a forward ledge confronting the spring forward end at least when the main housing teeth receivers move forwardly relative to and along the mounting piston teeth length and a first rear ledge confronting the spring rear end at least when the main housing teeth receivers move forwardly relative to and along the mounting piston teeth length.

6. The firearm booster system of claim 5 wherein the spring forward end is rearwardly located relative to the forward groove and the spring rear end is forwardly located relative to the rear groove.

7. The firearm booster system of claim 6 wherein the mounting piston exterior further comprises a mounting piston flange forming a mounting piston ledge spaced about the mounting piston circumference, the mounting piston ledge adjacent to the mounting piston teeth, wherein the housing interior of the main housing comprises a second rear ledge rearwardly disposed to the first rear ledge, wherein the mounting piston ledge contacts the second rear ledge when the main housing is in the start position and the mounting piston ledge does not contact the second rear ledge when the main housing teeth receivers move forwardly relative to and along the mounting piston length, and further wherein the rear groove is located between the first rear ledge and second rear ledge.

8. The firearm booster system of claim 1 further comprising a locking cap comprising a locking cap forward end disposed forward relative to the mounting piston forward end, a locking cap rear end, a locking cap length extending from the locking cap forward end to the locking cap rear end, a locking cap interior, the locking cap at least partially disposed in the housing interior, the locking cap and the mounting piston comprise mating threads removably attaching the locking cap to the mounting piston, and further wherein the main housing is configured to move forwardly relative to the locking cap when firing the firearm.

9. The firearm booster system of claim 8 wherein, upon firing the firearm, the firearm booster system is configured to deliver the ammunition and gas through the mounting piston interior, through the locking cap interior and out of the locking cap forward end without the gas contacting the compressible spring.

10. The firearm booster system of claim 8 wherein the locking cap comprises a forward ledge and a groove disposed forwardly relative to the forward ledge and further wherein the forward end of the spring rests upon the forward ledge at least when the main housing teeth receivers move forwardly relative to and along the mounting piston teeth length.

11. The firearm booster system of claim 10 wherein the locking cap groove comprises a forward O-ring.

12. The firearm booster system of claim 1 wherein the housing teeth receivers are configured to move from the start position and return to the start position without the main housing rotating relative to the mounting piston.

13. The firearm booster system of claim 1 wherein the muzzle and the mounting piston interior comprises mating threads removably attaching the mounting piston to the muzzle.

14. The firearm booster system of claim 1 wherein the firearm is a pistol comprising a slide and the muzzle is configured to move vertically upwardly when firing ammunition.

15. The firearm booster system of claim 1 wherein the spring is a wave spring.

16. The firearm booster system of claim 1 wherein the housing interior of the main housing comprises a forward ledge confronting the spring forward end at least when the main housing teeth receivers move forwardly relative to and along the mounting piston teeth length and a rear ledge confronting the spring rear end at least when the main housing teeth receivers move forwardly relative to and along the mounting piston teeth length.

17. The firearm booster system of claim 1 further comprising a suppressor barrel attached to the housing exterior, the housing exterior further comprising threads, the suppressor barrel comprising an interior comprising at least one baffle, the suppressor barrel configured to reduce noise when the ammunition is fired from the firearm, the suppressor barrel interior further comprising suppressor barrel interior threads mating with the housing exterior threads.

18. The firearm booster system of claim 17 wherein the suppressor barrel comprises a forward end, the firearm booster system configured to fire ammunition from the muzzle through the mounting piston interior, through the housing interior, through the suppressor barrel interior and out the suppressor barrel forward end upon firing the firearm.

19. The firearm booster system of claim 17 wherein the suppressor is configured to move with the main housing as the main housing teeth move relative to the mounting piston teeth.

20. A method of using a firearm booster system comprising the steps of:

a) providing the firearm booster system of claim 18;

b) firing the firearm;

c) moving the main housing and the suppressor barrel forwardly relative to the muzzle and the mounting piston and ejecting ammunition from the muzzle through the mounting piston interior, through the suppressor barrel interior and out of the suppressor barrel forward end, the suppressor barrel reducing noise emanating from the firearm.

21. The firearm booster system of claim 1 wherein each of the housing teeth receivers and the mounting piston teeth have a length of between about 1/8 of an inch to about 3/16 of an inch.

22. A firearm booster system comprising:

a) a firearm comprising a trigger and a gun barrel comprising a muzzle configured to fire ammunition;

b) a mounting piston comprising a rear end attached to the muzzle, a forward end, a mounting piston length extending from the forward end to the rear end, a mounting piston interior, and a mounting piston exterior comprising a mounting piston circumference generally perpendicular to the mounting piston length, a plurality of mounting piston teeth spaced about the mounting piston circumference, wherein the plurality of mounting piston teeth have a length generally parallel to the mounting piston length;

c) a main housing comprising a housing forward end, a housing rear end, a housing length extending from the housing forward end to the housing rear end, a housing exterior, a housing interior comprising a housing interior circumference extending generally perpendicular to the housing length and a plurality of housing teeth receivers spaced about the housing interior circumference, the plurality of housing teeth receivers configured to mate with the mounting piston teeth and having a length generally parallel to the mounting piston length, the main housing interior comprising a portion of the mounting piston;

d) a compressible spring extending along at least a portion of the housing length and located in the housing interior of the main housing, the compressible spring comprising a rear end and a forward end, the compressible spring having a relaxed length and a compressed length; and e) a locking cap comprising a locking cap forward end disposed forward relative to the mounting piston forward end, a locking cap rear end, a locking cap length extending from the locking cap forward end to the locking cap rear end, a locking cap interior, the locking cap at least partially disposed in the housing interior, the locking cap and the mounting piston comprise mating threads removably attaching the locking cap to the mounting piston, wherein the mounting piston is partly disposed in the housing interior of the main housing, wherein the firearm booster system further comprises a rear seal disposed forwardly relative to the mounting piston teeth and rearwardly relative to the spring rear end and a forward seal disposed forward to the rear seal and forward relative to the spring forward end, the forward seal and the rear seal disposed in the housing interior of the main housing, and further wherein the firearm booster system is configured to deliver the ammunition and gas through the mounting piston interior, through the locking cap interior and out of the locking cap forward end without the gas contacting the compressible spring.

* * * * *